US011794978B2

(12) United States Patent
Terrasi

(10) Patent No.: US 11,794,978 B2
(45) Date of Patent: Oct. 24, 2023

(54) SEALED PACKAGING FOR A CONFECTIONERY PRODUCT

(71) Applicant: SOREMARTEC S.A., Findel (LU)

(72) Inventor: Giuseppe Terrasi, Benevello (IT)

(73) Assignee: SOREMARTEC S.A., Findel (LU)

( * ) Notice: Subject to any disclaimer, the term of this patent is extended or adjusted under 35 U.S.C. 154(b) by 926 days.

(21) Appl. No.: 15/322,299

(22) PCT Filed: Jun. 30, 2015

(86) PCT No.: PCT/IB2015/054896
§ 371 (c)(1),
(2) Date: Dec. 27, 2016

(87) PCT Pub. No.: WO2016/001829
PCT Pub. Date: Jan. 7, 2016

(65) Prior Publication Data

US 2017/0129675 A1 May 11, 2017

(30) Foreign Application Priority Data

Jun. 30, 2014 (IT) ..... TO2014A000521

(51) Int. Cl.
*B65D 75/32* (2006.01)
*B65B 25/00* (2006.01)
(Continued)

(52) U.S. Cl.
CPC ..... *B65D 75/32* (2013.01); *B65B 5/04* (2013.01); *B65B 9/045* (2013.01); *B65B 25/005* (2013.01);
(Continued)

(58) Field of Classification Search
CPC ..... B65D 75/32; B65D 85/60; B65B 25/005; B65B 5/04
See application file for complete search history.

(56) References Cited

U.S. PATENT DOCUMENTS 3,454,210 A * 7/1969 Spiegel ..... B65D 75/30 229/123.1
9,663,253 B2 * 5/2017 Federici ..... B65B 11/02
(Continued)

FOREIGN PATENT DOCUMENTS

DE 3243500 * 5/1984
EP 0110080 A1 * 6/1984 ..... B65B 57/10
(Continued)

OTHER PUBLICATIONS

Machine translation of JP325793 (Year: 2003).*
(Continued)

*Primary Examiner* — Erik Kashnikow
*Assistant Examiner* — Lela S. Davis
(74) *Attorney, Agent, or Firm* — ROTHWELL, FIGG, ERNST & MANBECK, P.C.

(57) ABSTRACT

Sealed packaging for a confectionery product Food product packaging comprising a food product (P) in a sealed wrapper of sheet material, comprising a first sheet (2) shaped in a receiving configuration adapted to contain the product, having an end edge in the shape of a flange (4) and a second sheet (6) adhered to said flange (4) to form a sealed wrapper surrounding the product (P), comprising a body of sheet material (8) in the shape of a cup with a base (10) and a side wall (12), where the base (10) is made to adhere to said second sheet (6) and the adhesive force between said base (10) and said second sheet (6) is greater than the adhesive force between the second sheet (6) and said flange (4), so that a force tending to separate said body from the packaging causes the detachment of said second sheet (6) from the flange (4) with the opening of the packaging.

16 Claims, 1 Drawing Sheet

Figure 2:
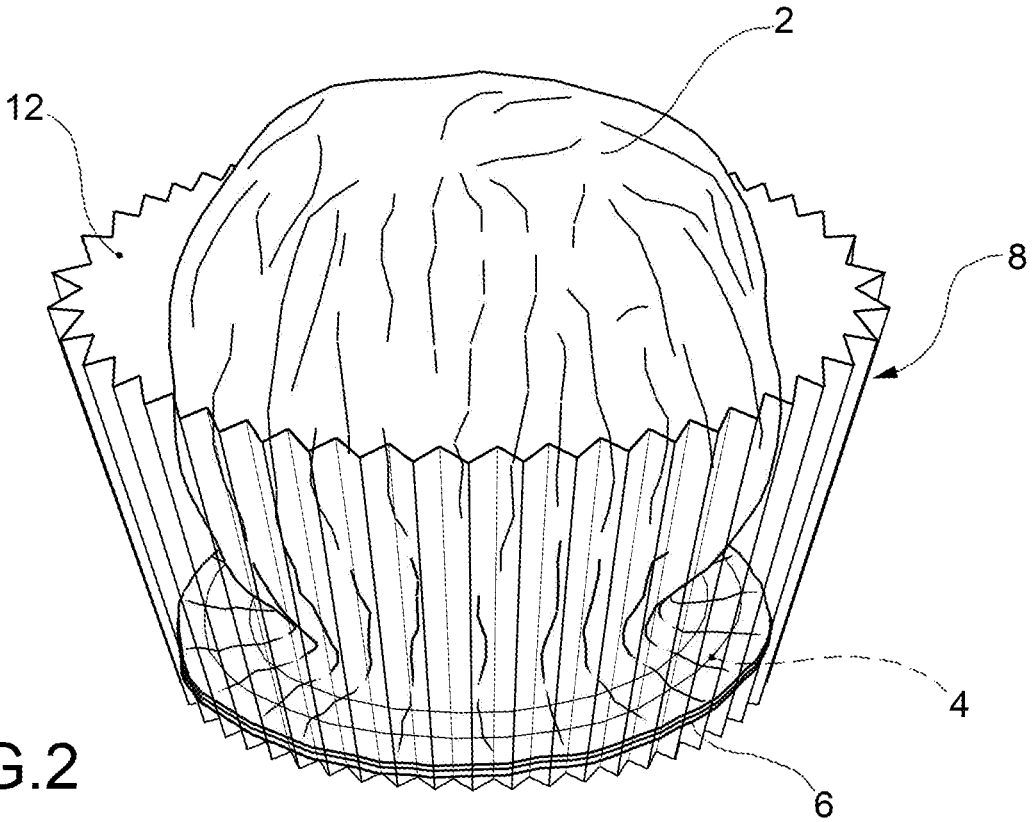

(51) Int. Cl.

| | |
|---|---|
| ***B65D 85/60*** | (2006.01) |
| ***B65D 25/10*** | (2006.01) |
| ***B65B 5/04*** | (2006.01) |
| ***B65B 9/04*** | (2006.01) |
| ***B65B 51/02*** | (2006.01) |
| ***B65B 51/22*** | (2006.01) |
| ***B65D 65/02*** | (2006.01) |
| ***B65D 65/40*** | (2006.01) |
| ***B65D 65/42*** | (2006.01) |

(52) U.S. Cl.
CPC ..... *B65B 51/02* (2013.01); *B65B 51/225* (2013.01); *B65D 25/10* (2013.01); *B65D 65/02* (2013.01); *B65D 65/40* (2013.01); *B65D 65/42* (2013.01); *B65D 85/60* (2013.01)

(56) References Cited

U.S. PATENT DOCUMENTS

2002/0172834 A1* 11/2002 Rivett ..... B32B 27/08 428/515
2005/0003049 A1* 1/2005 Terrasi ..... A23G 3/563 426/106

FOREIGN PATENT DOCUMENTS

| | | | | |
|---|---|---|---|---|
| EP | 1046579 | A1 * | 10/2000 | ..... B65B 25/005 |
| EP | 1046579 | A1 | 10/2000 | |
| GB | 2130546 | A | 6/1984 | |
| JP | 3425793 | B2 * | 7/2003 | ..... B65B 25/005 |
| WO | 2008018008 | A1 | 2/2008 | |
| WO | 2009084045 | A1 | 7/2009 | |
| WO | 2012/098524 | A1 | 7/2012 | |

OTHER PUBLICATIONS

Malabaguio, How to make candy bouquets; https://www.entrepreneur.com.ph/startup-tips/how-to-make-candy-bou (Year: 2012).*
Petrovich, RU 2309878 Machine Translation (Year: 2007).*
International Search Report issued in PCT/IB2015/054896, dated Sep. 23, 2015, 6 pages.

* cited by examiner

SEALED PACKAGING FOR A CONFECTIONERY PRODUCT

CROSS REFERENCE TO RELATED APPLICATION

This application is a 35 U.S.C. 371 National Phase Entry Application from PCT/IB2015/054896, filed Jun. 30, 2015, which claims the benefit of Italian Patent Application No. TO2014A000521 filed on Jun. 30, 2014, the disclosure of which are incorporated by reference in their entirety.

The present invention relates to packaging for a confectionery product, such as, in particular, a praline or the like, in which the food product is wrapped in a sealed wrapper, mostly adhering to the outer surface of the product, so as to limit the volume of air in contact with the product inside the wrapper and avoid, or in any case limit, the phenomena of exchange between the atmosphere inside the wrapper and the external atmosphere.

This type of sealed wrapper is evidently desirable for the purpose of improving the preservation of the organoleptic characteristics of the packaged product, particularly as regards preservation from oxidation phenomena. However, this type of wrapper is not, in practice, used commercially for packaging high quality confectionery products such as pralines, for which, although they are produced on a large industrial scale, it is desirable to provide packaging which enhances their value, and is therefore as similar as possible to hand-made packaging.

Thus, a form of packaging typical of high quality pralines, such as the Rocher® pralines made by Ferrero S.p.A., comprises a single sheet, typically of aluminium, which is wrapped closely around the product and whose peripheral edges are pressed down on to the product so as to form a closed, but not sealed, wrapper, and a case (a pleated cup) whose base surface is made to adhere to the pressed-down edges of the wrapper to retain the product inside the cup, thereby producing a form of packaging and presentation typical of confectionery products.

In order to form packaging with a sealed wrapper, as mentioned above, it is desirable for the wrapper to adhere as closely as possible to the body of the product, in order to limit the internal air volume, while also emphasizing the shape of the product.

In this context, WO 2012/098524 describes a method for packaging a praline in a sealed wrapper, adhering to the praline as far as possible, and using two wrapper sheets. The first sheet is shaped by pressing into a beaker-like configuration with a radial annular flange surrounding its mouth; the product is inserted into the first sheet shaped in this way, and the wrapper is then constricted below the flange, using an iris-like tool; a second wrapper sheet, generally flat, is then bonded or glued to the annular flange, forming a sealed wrapper.

In one embodiment, the second wrapper sheet can take the form of a pleated cup, the base of which is connected to the annular flange, with the side wall of the cup initially facing in the opposite direction from the product; this side wall is then folded over towards the product, forming packaging which includes the pleated cup as an integral part of the packaging.

This solution requires the use of sheet materials which have barrier properties and are preferably heat-sealable, for example multi-layer sheets such as laminates of aluminium/plastic material, paper/plastic material, or paper/metallized plastic material, and it cannot be used to produce packaging which, in terms of its appearance, is presented to the consumer as a typical confectionery product in which the pleated cup is made of paper material.

The object of the invention is primarily to provide sealed packaging which, in terms of its appearance, takes the form of typical packaging of the hand-made or confectionery type, and which can therefore be used, particularly for the packaging of pralines or the like, as a replacement for the non-sealed packaging which is routinely used and has been described previously, thus meeting the requirements and expectations of the consumer.

The invention also has the aim of providing packaging which, within the scope of the primary object outlined above, can easily be opened by the consumer for the removal of the product.

In view of these objects, the invention provides a food product packaging and a method for its preparation, having the characteristics defined in the claims below, which form an integral part of the present description.

Figure 1:
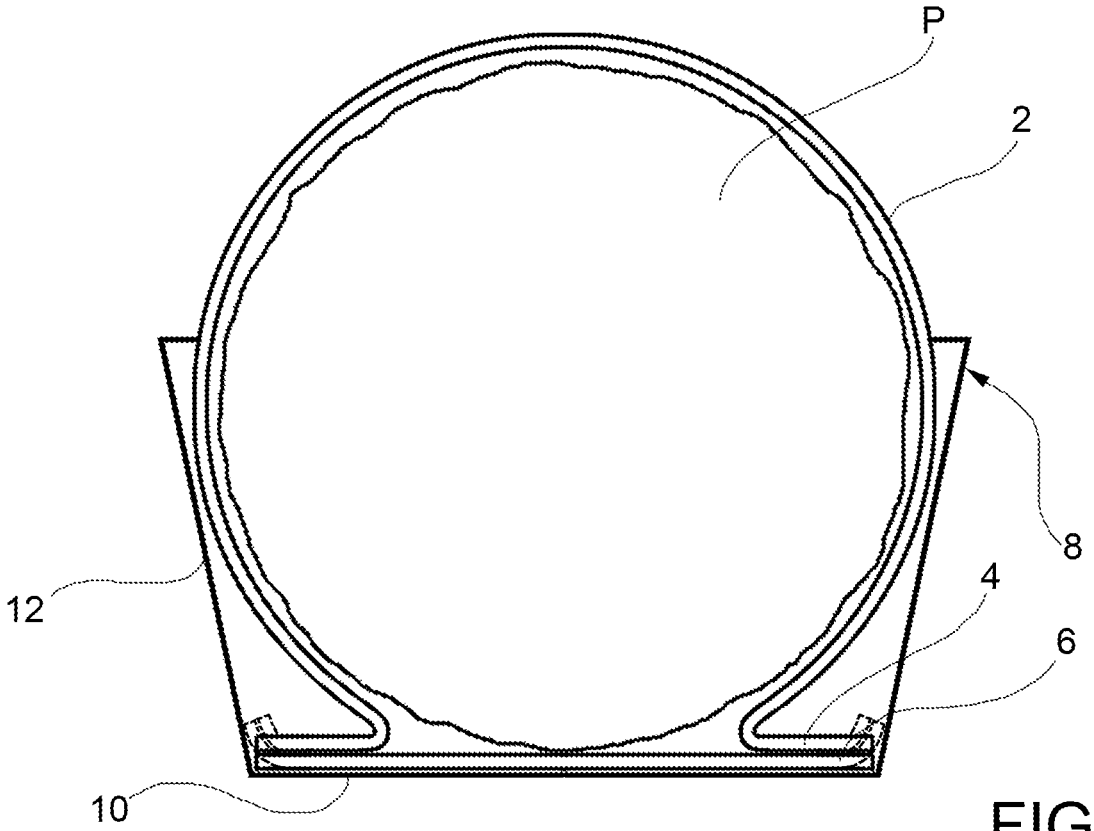

Further characteristics and advantages of the packaging according to the invention will be evident from the following detailed description, provided by way of non-limiting example with reference to appended drawings, in which:

FIG. 1 is a sectional view of the packaging including the corresponding product; and FIG. 2 is a perspective view in partial section of the packaging of FIG. 1, in which the cup is shown as transparent, simply for the sake of greater clarity of representation.

With reference to the drawings, the packaging comprises a first wrapper sheet 2, typically shaped by a pressing process, so as to wrap and substantially surround the whole body of the product P introduced into it.

The sheet 2 is shaped so as to have, at its mouth which provides access to the inner cavity in which the product P is housed, an annular radial flange 4 which is preferably placed substantially flush with the end of the surface of the product P.

In the illustrated configuration, in which the product P is a praline of substantially spherical shape, the sheet 2 is shaped with a cross section resembling the Greek letter Ω, so that the wrapper sheet can adhere as closely as possible to the outer surface of the product P. This configuration can be obtained, for example, by following the method described in WO 2012/098524, incorporated herein by reference document.

In particular, according to this method the first sheet 2 is initially shaped in a beaker configuration, comprising a base portion, which is substantially complementary to a base portion of the surface of the product, and a tubular portion, which extends above the top of the product when the latter is inserted into the sheet shaped in this way, and which forms a mouth for the introduction of the product and a terminal portion in the form of an annular flange surrounding the mouth.

When the product has been inserted into the first shaped sheet, the shaped sheet being kept with its mouth facing upwards, an operation of constricting the region of the tubular portion located above the top of the product is performed, preferably while exerting a pressure on the annular flange which can secure the edges of the flange or limit its radial sliding, so as to cause the adhesion of the tubular wall to a substantial portion of the top surface of the product.

In WO 2012/098524, the aforesaid constriction operation is performed using an iris shutter. However, it is to be understood that this constriction, when desired or necessary, can equally well be performed by other means, for example by using a mandrel with petals of the type described in WO 2008/018008, also in the name of the present applicant, although the latter tool is less advantageous than the aforesaid iris shutter tool for achieving close adhesion of the wrapper to the product.

Additionally, although the method and equipment described in WO 2012/098524 are particularly advantageous for the packaging of products of substantially spherical shape, or products with portions which are crown-shaped or tapered in their part facing the mouth of the wrapper, it is to be understood that, since the packaging proposed by the invention is not in any way limited to the packaging of products having this configuration, the aforesaid constriction operation is purely optional.

Thus, for example, in the case of a praline of frustoconical or frustopyramidal shape, the wrapper sheet 2 will be configured by pressing into a shape substantially complementary to the side wall of the praline, with the flange 4 substantially flush with the surface of the larger base of the praline.

As mentioned above, however, it is important to configure the first wrapper sheet with a radial flange, indicated by 4, which is substantially flat.

A second substantially flat wrapper sheet 6 is then connected, in its peripheral annular region, to the flange 4. This connection can be provided by heat-sealing, ultrasonic welding, infrared welding, or gluing, thus forming a closed and sealed wrapper.

The sheets 2 and 6 may be made from a wide range of materials, provided that they are suitable for contact with food; preferably, they are materials having barrier properties in respect of oxygen transfer.

The materials used comprise single-layer materials, such as aluminium foil, plastic materials such as polypropylene or more preferably polyester (PET), or multi-layer materials such as composite materials or materials co-extruded as laminates of aluminium/plastic material, paper/plastic material, or paper/metallized plastic material; a preferred material may be a laminate of aluminium foil with a sheet of polyester (PET).

In particular, it may be preferable to use materials suitable for heat-sealing, so that the two sheets 2 and 6 can be coated on their sides intended to face the product with a heat-sealing lacquer or a layer of heat-sealing material.

The packaging further comprises a cup-shaped body having a flat base wall 10 and a side wall 12, preferably pleated. The base wall 10 of the cup, typically of circular shape, has dimensions such that the sheet 6, forming the closing element of the wrapper and having a perimetric edge generally matching the perimetric edge of the flange 4, can be inserted so as to bear against the aforesaid base wall 10. The size (diameter) of the base wall 10 of the cup may be substantially equal to or slightly smaller than the sizes (diameters) of the sheet 6 and the corresponding flange 4, or may be greater than them, in which case the sheet 6 and the corresponding flange 4 have a curved annular peripheral region in contact with the side wall 12 of the cup, as indicated by the broken line in FIG. 1. The side wall 12 of the cup, generally flared, in this position surrounds the shaped sheet 2.

The base wall 10 is connected to the sheet 6, preferably by gluing and preferably with a hot-melt glue.

The gluing may take place over the whole surface of the base 10 and the sheet 6, or solely on an annular peripheral region thereof, or solely on spots or portions of an annular peripheral region thereof.

According to a characteristic of the invention, the adhesive force between the base surface 10 of the cup and the outer surface of the sheet 6 is greater than the adhesive force between the flange 4 and the wrapper sheet 6. Thus the cup 8 not only has a function in terms of appearance, but also acts as a graspable element for facilitating the opening of the packaging. For this purpose, the consumer intending to remove the product P from the packaging can grasp the side wall of the cup, fold it over on to the opposite side from the product, and then exert a tractive force on this side wall, which, owing to the greater adhesive force between the base 10 and the sheet 6, causes the sheet 6 to be detached from the flange 4, thus enabling the packaging to be opened.

In particular, the adhesive force exerted by the glue between the surface of the cup and the sheet 6 may be from 1.2 to 2 or more times greater than the adhesive force between the flange 4 and the surface of the sheet 6.

In the preferred embodiment, the cup 8 is made from a conventional paper material which is inexpensive and easily pleatable. In fact, since the cup 8 plays no part in sealing the packaging, any of the paper materials commonly used in the field of hand-made goods can be used for this cup.

Thus the invention provides a novel packaging in a sealed wrapper which can easily be used to replace conventional non-sealed packaging, while making it possible to meet the requirements in terms of appearance which are of considerable importance for consumer choice, and, naturally, while improving the preservation of the organoleptic characteristics of the products over time.

It is to be understood that, provided that the principle of the invention is retained, the details of application and the forms of embodiment can be varied widely from what has been described and illustrated by way of non-limiting example, without departure from the scope of the claims attached below.

Thus, in particular, it is to be understood that the shape of the product may be varied considerably from that which is illustrated, with consequent variations in the configuration of the wrapper; it is also to be understood that the materials of the packaging can be varied from those specifically mentioned, according to the requirements for specific packaging.

The invention claimed is:

1. Food product packaging comprising a food product in a sealed wrapper of sheet material, said sealed wrapper consisting of a first sheet shaped in a receiving configuration adapted to contain said product, having an end edge in the shape of a substantially flat radially extending flange and of a substantially flat second sheet adhesively connected to said flange by heat sealing, ultrasonic welding or infrared welding, to form a sealed wrapper surrounding the product, said food product packaging further comprising a body of sheet material in the shape of a cup with a flat base and a foldable side wall, wherein said second sheet is adhesively connected in a substantially flat configuration, to said base by gluing, on a plurality of spots of hot melt glue, an annular peripheral region of said base and wherein the adhesive force between said base and said second sheet is greater than the adhesive force between the second sheet and said flange, so that when a pulling force is applied to the foldable side wall, the second sheet is detached from the flange and opens the sealed wrapped food product.

2. Packaging according to claim 1, wherein said first sheet is constituted by a single layer sheet of plastic material suitable for contact with food or by a multilayer sheet of aluminium/plastic material, paper/plastic material, or paper/metalized plastic material.

3. Packaging according to claim 2, wherein said first sheet has a heat-sealable coating on the side facing the food product.

4. Packaging according to claim 1, wherein said first and second sheets are constituted by a film of polypropylene or polyester, or by a laminate of aluminium and polyester.

5. Packaging according to claim 4, wherein said first and second sheets are constituted by a film of polyethylene terephthalate.

6. Packaging according to claim 4, wherein said first and second sheets are constituted by a laminate of polyethylene terephthalate.

7. Packaging according to claim 1, wherein said cup-shaped body is of paper material.

8. Packaging according to claim 7, wherein said side wall of said cup-shaped body is pleated.

9. Packaging according to claim 1, wherein the adhesive force between said base of the cup-shaped body and said second sheet is equal to 1.2-2 times the adhesive force between said second sheet and said flange.

10. Packaging according to claim 1, wherein said food product is a praline of substantially spherical shape and said first sheet is shaped so as to present a tubular portion, said tubular portion having a constriction, defining an opening, adjacent to said flange and wherein said first sheet closely adheres to the product.

11. Packaging according to claim 1, wherein said second sheet is constituted by a single layer sheet of plastic material suitable for contact with food or by a multilayer sheet of aluminium/plastic material, paper/plastic material, or paper/metallized plastic material, optionally provided on the side facing the food product with a heat-sealable coating.

12. Packaging according to claim 11, wherein said second sheet has a heat-sealable coating on the side facing the food product.

13. Packaging according to claim 1, consisting of said food product in said sealed wrapper of sheet material, and said body of sheet material in the shape of a cup with a flat base and a side wall.

14. Method for the production of a packaged food product according to claim 1, comprising the operations of:

shaping said first sheet into a receiving configuration having a substantially flat radially extending annular flange adjacent to its mouth;

inserting the food product into said first sheet so as to wrap and substantially surround the whole body of said food product;

connecting said second sheet to said annular flange so as to form a closed wrapper around said product; and adhesively connecting said second sheet to the base surface of a cup-shaped body having a substantially flat base.

15. Method according to claim 14, wherein said product is of substantially spherical shape, the method further comprising the operation of making a constriction in said first sheet in a position immediately adjacent to said annular flange, so as to cause the adhesion of said first sheet to a substantial portion of the surface of the product.

16. Food product packaging comprising a food product in a sealed wrapper of sheet material, said sealed wrapper consisting of a first sheet shaped in a receiving configuration adapted to contain said product, having an end edge in the shape of a radially extending flange and of a substantially flat second sheet adhesively connected to said flange by heat sealing, ultrasonic welding or infrared welding to form a sealed wrapper surrounding the product, said food product packaging further comprising a body of sheet material in the shape of a cup with a flat base and a foldable side wall, wherein said second sheet is adhesively connected in a substantially flat configuration to said base by gluing on a plurality of spots of hot melt glue an annular peripheral region of said base, wherein said base of the cup has a dimension lower than the dimension of said second sheet, whereby said second sheet and the corresponding flange of the first sheet have a curved annular peripheral region in contact with the side wall of the cup, and the adhesive force between said base and said second sheet is greater than the adhesive force between the second sheet and said flange, so that when a pulling force is applied to the foldable side wall, the second sheet is detached from the flange and opens the sealed wrapped food product.

* * * * *